US006755434B2

(12) United States Patent
Deborde et al.

(10) Patent No.: US 6,755,434 B2
(45) Date of Patent: Jun. 29, 2004

(54) PROCESS FOR PRODUCING A BOARD FOR GLIDING OVER SNOW, REINFORCEMENT, AND BOARD FOR GLIDING OVER SNOW COMPRISING SUCH A REINFORCEMENT

(75) Inventors: Henri-Charles Deborde, Bilieu (FR); Bernard Chaumat, Chirens (FR)

(73) Assignee: Skis Rossignol, S.A., Voiron (FR)

( * ) Notice: Subject to any disclaimer, the term of this patent is extended or adjusted under 35 U.S.C. 154(b) by 129 days.

(21) Appl. No.: 10/079,335

(22) Filed: Feb. 20, 2002

(65) Prior Publication Data

US 2002/0113409 A1 Aug. 22, 2002

(30) Foreign Application Priority Data

Feb. 22, 2001 (FR) ..... 01 02413

(51) Int. Cl.[7] ..... A63C 5/07
(52) U.S. Cl. ..... 280/602; 280/610; 280/609
(58) Field of Search ..... 280/601, 602, 280/608, 609, 610, 14.21

(56) References Cited

U.S. PATENT DOCUMENTS

| | | | | | |
|---|---|---|---|---|---|
| 3,807,746 | A | * | 4/1974 | Kofler | 280/610 |
| 3,902,732 | A | * | 9/1975 | Fosha et al. | 280/610 |
| 4,068,861 | A | * | 1/1978 | Zemke, Jr. | 280/610 |
| 4,647,061 | A | * | 3/1987 | Girard | 280/602 |
| 5,288,442 | A | | 2/1994 | Bauvois | 264/45.2 |
| 5,292,148 | A | * | 3/1994 | Abondance et al. | 280/602 |
| 5,427,401 | A | * | 6/1995 | Liard | 280/609 |
| 5,599,036 | A | * | 2/1997 | Abondance et al. | 280/602 |
| 5,836,604 | A | * | 11/1998 | Piegay | 280/607 |
| 5,944,336 | A | * | 8/1999 | Fagot | 280/607 |
| RE36,453 | E | * | 12/1999 | Abondance et al. | 280/609 |
| RE36,586 | E | * | 2/2000 | Abondance et al. | 280/602 |
| 6,102,428 | A | * | 8/2000 | Bobrowicz | 280/607 |
| 6,113,126 | A | * | 9/2000 | Zanco et al. | 280/610 |
| 6,237,932 | B1 | * | 5/2001 | Zanco et al. | 280/602 |
| 6,612,605 | B2 | * | 9/2003 | Andrus et al. | 280/610 |
| 6,679,513 | B1 | * | 1/2004 | Emig et al. | 280/602 |

FOREIGN PATENT DOCUMENTS

| | | |
|---|---|---|
| FR | 2678543 | 1/1993 |
| JP | 07265483 | 10/1995 |

* cited by examiner

*Primary Examiner*—Brian L. Johnson
*Assistant Examiner*—Bridget Avery
(74) *Attorney, Agent, or Firm*—Heslin Rothenberg Farley & Mesiti P.C.; Victor A. Cardona, Esq.

(57) ABSTRACT

Board for gliding over snow (1) comprising a gliding sole plate (2) bordered by metal side edges (3), an upper protective and decorative layer (4), and a filler core (6), including, on at least one of its faces, the lower face and/or the upper face, at least one internal rigid reinforcement (5), wherein this internal rigid reinforcement has at least one laterally flush zone (9, 11) in the region of the heel of the board for gliding over snow so as to allow the centering of the median longitudinal axis of said reinforcement relative to the median longitudinal axis of the board for gliding over snow.

10 Claims, 2 Drawing Sheets

PROCESS FOR PRODUCING A BOARD FOR GLIDING OVER SNOW, REINFORCEMENT, AND BOARD FOR GLIDING OVER SNOW COMPRISING SUCH A REINFORCEMENT

FIELD OF THE INVENTION

The present invention relates to a process for producing a board for gliding over snow, which comprises an internal rigid reinforcement.

The present invention also relates to an internal rigid reinforcement intended for a board for gliding over snow.

The present invention finally relates to a board for gliding over snow which comprises an internal rigid reinforcement.

PRIOR ART

The traditional process for producing a board for gliding over snow, particularly for a downhill ski or a snowboard, will comprise the following initial stages which consist in:

- selecting a mold with the dimensions desired for the board for sliding;
- positioning a gliding sole plate in this mold;
- bordering this gliding sole plate with two metal side edges;
- positioning a first reinforcement of preimpregnated laminated type over the gliding sole plate; and
- positioning a rigid reinforcement over these abovementioned first elements which are already present.

The drawback of these prior techniques lies in the fact that the rigid reinforcement may have a variable position relative to the rest of the elements, i.e. the gliding sole plate, the side edges, and the laminated first reinforcement. In fact, the rigid reinforcement may be offset laterally relative to these same elements. More precisely, the internal rigid reinforcement will be located off center relative to the median longitudinal axis of the board for gliding over snow.

These centering defects lead to a ski being obtained which has very mediocre variable dimensional and mechanical characteristics. When used on the snow, the behavior of the skis obtained in this way will also be variable. These centering defects lead to overlapping of the reinforcements, generating deformations in the structure of the board for gliding.

These centering defects lead to an absence of homogeneity in the manufacture of the boards for gliding and in their behavior on snow.

SUMMARY OF THE INVENTION

A first problem which arises consists in developing a process for producing a board for gliding over snow which comprises a special stage of fitting a reinforcement which is shaped so that it can be centered without difficulty and without specific tools.

A second problem which arises is that of designing a reinforcement whose actual configuration enables it to be centered automatically relative to the median longitudinal axis of the board for gliding.

A third problem which arises is that of forming a board for gliding over snow which has a longitudinally centered reinforcement.

According to a first aspect of the present invention, a process for producing a board for gliding over snow is noteworthy in that it comprises, in particular, the following initial stages which consist positioning a gliding sole plate in a mold, bordering this sole plate with two metal side edges, positioning a first reinforcement of preimpregnated laminated type over the gliding sole plate, and finally positioning at least one rigid reinforcement which comprises at least one lateral protuberance located in the region of the heel so as to center said reinforcement relative to the median longitudinal axis of the board for gliding over snow.

Finally, there is preferably a stage of cutting or of punching the protuberance or protuberances of the reinforcement or reinforcements so that the reinforcement or reinforcements are flush without extending beyond the side edge defining the edges of the board for gliding. The protuberance or protuberances of the reinforcement or reinforcements may also have a length which is sufficient to abut against a shoulder present in the mold and extends laterally beyond the edge of the mold defining the edges of the board.

According to a second aspect of the present invention, a reinforcement intended for use in a board for gliding over snow is noteworthy in that it comprises at least one lateral protuberance positioned in the region of the heel zone.

The reinforcement advantageously comprises two protuberances. Preferably, the reinforcement consists of a metal sheet with a thickness of between 0.2 and 1.2 mm. The reinforcement may consist of a rigid laminated plate of fiberglass and/or carbon fiber and/or aramide fiber.

A board for gliding over snow comprises a gliding sole plate bordered by metal side edges, an upper protective and decorative layer, and a filler core, including, over at least one of its faces, the lower and/or the upper face, at least one internal rigid reinforcement.

According to a third aspect of the present invention, the board for gliding over snow is noteworthy in that this internal rigid reinforcement has at least one laterally flush zone in the region of the heel of the board for gliding over snow so as to allow centering of the median longitudinal axis of said reinforcement relative to the median longitudinal axis of the board for gliding over snow.

In the more particularly advantageous board, the zone or zones of the reinforcement or reinforcements are laterally flush over a length of from 5 to 30 mm. The board for gliding over snow may comprise an internal rigid reinforcement which has two flush side zones located on the right and on the left relative to the median longitudinal axis of the board for gliding.

DESCRIPTION OF THE DRAWINGS

The invention will be properly understood and its various advantages and different characteristics will become more apparent during the following description of the non-limiting illustrative embodiment, with reference to the appended diagrammatic drawings, in which.

DETAILED DESCRIPTION

Figure 1:
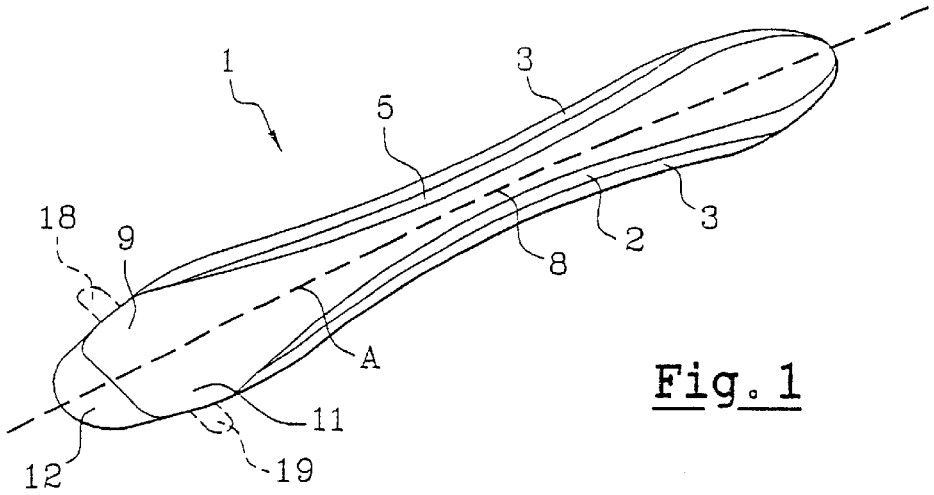
FIG. 1 shows a perspective view of a board for gliding over snow, during its manufacture.
Figure 2:
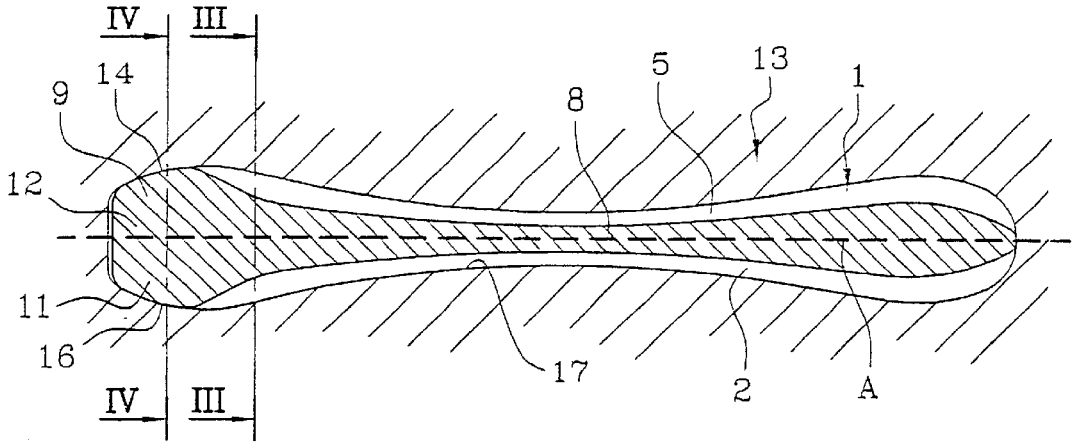
FIG. 2 shows a top view of the board for gliding over snow positioned in a mold, during manufacture.
Figure 3:
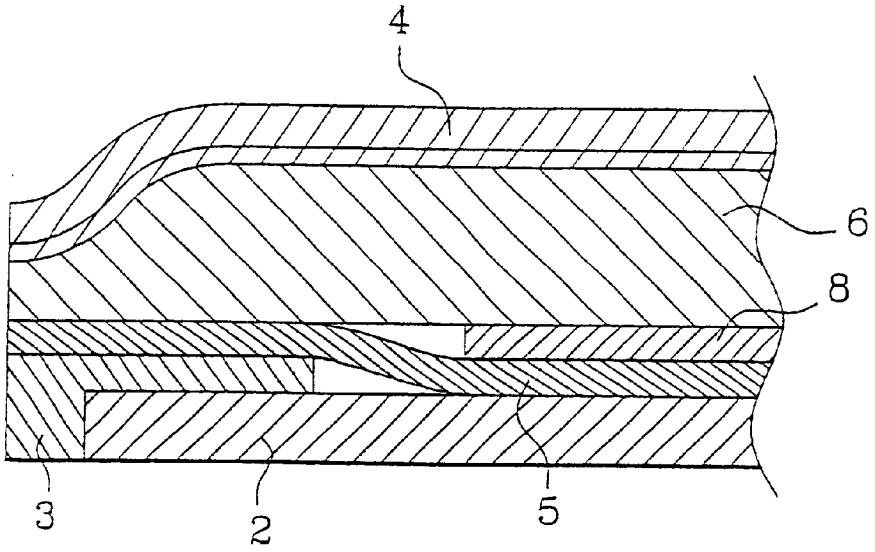
FIG. 3 shows a partial view in transverse section along III—III in FIG. 2.
Figure 4:
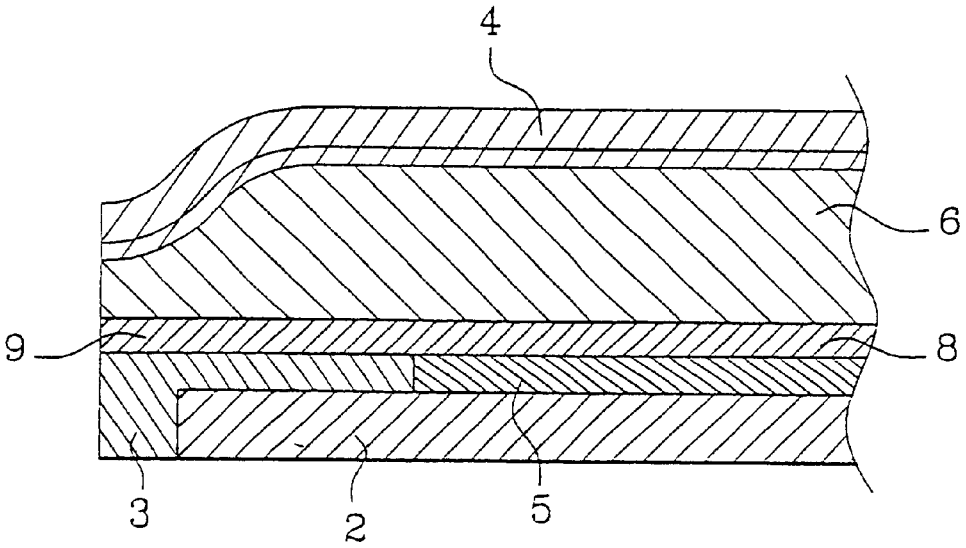
FIG. 4 shows a partial view in transverse section along IV—IV in FIG. 2.

A board (1) for gliding over snow comprises, in succession, a gliding sole plate (2) bordered by metal side edges (3), an upper protective and decorative layer (4), and a filler core (6) which includes, on at least one of its lower faces, an internal rigid reinforcement (8). The board for gliding also comprises, in addition, a reinforcement (5), for example of the preimpregnated type, positioned over the gliding sole plate (2). The rigid reinforcement (8) is generally placed over this reinforcement (5) of laminated type.

According to the invention, the rigid reinforcement (8) will comprise two protuberances (9) and (11) positioned laterally on either side of the median longitudinal axis A of the board (1) for gliding. These two protuberances (9) and (11) are also placed in the region of the heel zone (12) of the board (1) for gliding.

When the board is complete, the two protuberances or protuberance zones (9) and (11) are laterally flush in the region of the heel (12) of the board for gliding over snow. A flush length in the region of the edges varies, in practice, between 5 and 30 mm.

During production of the board for gliding over snow, the various elements are firstly put into place. A mold (13) is chosen as a function of the dimensions of the desired board for gliding. The sole plate (2) is placed in the bottom of the mold (13). Next, this sole plate is bordered by two metal side edges (3). A first reinforcement (5) of the preimpregnated laminated type is placed over the gliding sole plate (2). Next, the rigid reinforcement (8) which comprises these two protuberances (9) and (11) is wedged in the bottom of the mold (13).

By means of the two protuberances (9) and (11), the reinforcement (8) will be positioned perfectly in the bottom of the mold (13). The median longitudinal axis of the reinforcement (8) will line up with the median longitudinal axis A of the board for gliding over snow.

In order to obtain this perfect positioning of the rigid reinforcement (8), the two protuberances (9) and (11) will abut in two zones (14) and (16) respectively, against the wall (17) of the mold (13). These two zones (14) and (16) of contact mean that the reinforcement (8) will not be able to move laterally inside the mold (13).

It is also possible to provide two protuberances (18) and (19) which project to a great extend beyond the lateral edge (17) of the mold (13) (shown in broken lines in FIG. 1). As these two protuberances (18) and (19) project laterally relative to the edge of the mold (17), they will abut against a shoulder (not shown) which will be present inside the mold (13) and which will be some distance back from the lateral edge (17) of the mold (13).

The presence of these two, highly projecting, protuberances (18) and (19) means that there will be a final stage of cutting or of punching these two projections (18) and (19). This makes it possible to obtain a reinforcement (8) with just two flush lateral zones which do not project beyond the lateral edge defining the sides (3) of the board (1).

The metal reinforcement may be produced from various types of material. For example, a metal sheet with a thickness of between 0.2 and 1.2 mm may be used. A rigid laminated plate made from glass fibers and/or carbon fibers and/or aramide fibers is a particularly advantageous alternative.

The present invention is not limited to the embodiments described and illustrated. A number of modifications may be made without thereby departing from the context defined by the scope of the set of claims. For example, the board for gliding may comprise several rigid reinforcements (8), each comprising the centering protuberances (9, 11, 18, 19). The number of these protuberances or of these projections (9, 11, 18, 19) may be variable. These protuberances and these projections (9, 11, 18, 19) may have different shapes.

What is claimed is:

1. A rigid reinforcement for use in a board for gliding over snow, the board comprising a gliding sole plate bordered by metal side edges, a first reinforcement of preimpregnated laminated type over the gliding sole plate, an upper protective and decorative layer, and a filler core, said rigid reinforcement being located along a lower face of the filler core, which said rigid reinforcement comprising:

at least one lateral protuberance positioned in a heel zone of said board, a width of said rigid reinforcement beyond said at least one lateral protuberance being less than a width of said first reinforcement of preimpregnated laminated type.

2. The reinforcement as claimed in claim 1, further comprising two protuberance.

3. The reinforcement as claimed in claim 1, further comprising a metal sheet with a thickness of between 0.2 and 1.2 mm.

4. The reinforcement as claimed in claim 1, further comprising a rigid laminated plate of fiberglass and/or carbon fiber and/or aramide fiber.

5. The reinforcement as claimed in claim 2, further comprising a metal sheet with a thickness of between 0.2 and 1.2 mm.

6. The reinforcement as claimed in claim 2, further comprising a rigid laminated plate of fiberglass and/or carbon fiber and/or aramide fiber.

7. A board for gliding over snow which comprises a gliding sole plate bordered by metal side edges, a first reinforcement of preimpregnated laminated type over the gliding sole plate, an upper protective and decorative layer, and a filler core, including, along a lower face at least one internal rigid reinforcement, wherein this said at least one internal rigid reinforcement has at least one laterally flush zone in a region of a heel of the board for gliding over snow to allow centering of a median longitudinal axis of said at least one internal rigid reinforcement relative to a median longitudinal axis of the board for gliding over snow, a width of said at least one internal rigid reinforcement beyond said at least one laterally flush zone being less than a width of said first reinforcement of preimpregnated laminated type.

8. The board for gliding over snow as claimed in claim 7, wherein the at least one laterally flush zone is laterally flush over a length of from 5 to 30 mm.

9. The board for gliding over snow as claimed in claim 7, further comprising an internal rigid reinforcement which has two flush side zones located on the right and on the left relative to the median longitudinal axis of the board for gliding.

10. The board for gliding over snow as claimed in claim 8, further comprising an internal rigid reinforcement which has two flush side zones located on the right and on the left relative to the median longitudinal axis of the board for gliding.

* * * * *

UNITED STATES PATENT AND TRADEMARK OFFICE

CERTIFICATE OF CORRECTION

PATENT NO. : 6,755,434 B2
DATED : June 29, 2004
INVENTOR(S) : Deborde et al.

It is certified that error appears in the above-identified patent and that said Letters Patent is hereby corrected as shown below:

Column 4,
Line 14, delete the word "which" at the beginning of the line
Line 40, delete the word "this" before the word "said"

Signed and Sealed this

Tenth Day of August, 2004

JON W. DUDAS
*Acting Director of the United States Patent and Trademark Office*